US006212501B1

(12) United States Patent
Kaseno

(10) Patent No.: US 6,212,501 B1
(45) Date of Patent: Apr. 3, 2001

(54) SPEECH SYNTHESIS APPARATUS AND METHOD

(75) Inventor: Osamu Kaseno, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/114,150

(22) Filed: Jul. 13, 1998

(30) Foreign Application Priority Data

Jul. 14, 1997 (JP) ..... 9-188515

(51) Int. Cl.[7] ..... G10L 21/00; G10L 13/00
(52) U.S. Cl. ..... 704/258; 704/260; 704/270
(58) Field of Search ..... 704/260, 256, 704/258, 270

(56) References Cited

U.S. PATENT DOCUMENTS

| | | | | |
|---|---|---|---|---|
| 5,384,893 | | 1/1995 | Hutchins | 704/267 |
| 5,652,828 | * | 7/1997 | Silverman | 704/260 |
| 5,740,320 | * | 4/1998 | Itoh | 704/267 |
| 6,081,780 | * | 6/2000 | Lumelsky | 704/260 |

FOREIGN PATENT DOCUMENTS 8-63187 3/1996 (JP) .
9-50296 2/1997 (JP) .

* cited by examiner

*Primary Examiner*—David Hudspeth
*Assistant Examiner*—Susan Wieland
(74) *Attorney, Agent, or Firm*—Finnegan, Henderson, Farabow, Garrett & Dunner, L.L.P.

(57) ABSTRACT

A text segment selection unit extracts parameters of exemplary text segment of a user's choice and a fixed form portion in the exemplary text segment from an exemplary text segment database. A text segment input unit inputs a text segment of a user's choice to e embedded to an unfixed form portion in the exemplary text segment. A text segment generation unit concatenates the input text segment to the text segment of the fixed form portion. A parameter generation unit generates a parameter from the concatenated text segment. A parameter extraction unit extracts the parameter of the unfixed form portion from the generated parameter. A parameter embedding unit concatenates the parameter of the unfixed form portion to the parameter of the fixed form portion to generate a parameter for speech synthesis. A synthesis unit generates synthesized speech from this parameter. With this arrangement, more natural synthesis can be realized without any sense of incongruous prosody between the synthesis-by-rule portion and the analysis portion.

20 Claims, 5 Drawing Sheets

SYNTHESIS-BY-RULE PORTION
(INCLUDING SURROUNDING CONTEXT)

+

SYNTHESIS-BY-RULE PORTION
(PORTION TO BE USED)

ANALYSIS SYNTHESIS
PORTION

PARAMETER TO BE USED FOR SYNTHESIS

SPEECH SYNTHESIS APPARATUS AND METHOD

BACKGROUND OF THE INVENTION

The present invention relates to a speech synthesis apparatus for embedding, in an exemplary text segment including a fixed form portion having fixed contents and an unfixed form portion having varying contents, an arbitrary text segment which is specified by a user to the position of the unfixed form portion and generating synthesized speech of the exemplary text segment having the text segment embedded therein, and a method therefor.

In recent years, a variety of speech synthesis apparatuses for analyzing text in mixed Japanese letters and Chinese characters, synthesizing speech information of the text by synthesis by rule, and outputting voiced speech have been developed.

The basic arrangement of a speech synthesis apparatus of this type employing the synthesis-by-rule method is as follows. Speech utterances are analyzed in predetermined units, e.g., in units of CVs (consonant/vowel), CVCs (consonant/vowel/consonant), VCVs (vowel/consonant/vowel), or VCs (vowel/consonant) by LSP (line spectrum pair) analysis or cepstrum analysis to obtain phonetic information. The phonetic information is registered in a speech segment file. On the basis of this speech segment file and synthesis parameter (phonetic string and prosodic information) obtained upon analyzing text, voice source generation and synthesis filtering are performed to generate synthesized speech.

In text-to-speech synthesis by rule, a phonetic string and prosodic information are generated by analyzing text. Since both the phonetic string and the prosodic information are generated by rule, the resultant speech always has unnatural portions because of the imperfection of rule.

When text the sounds of which are to be produced is determined in advance, a technique called analysis synthesis is used. In this technique, the text is actually uttered by a person and analyzed to generate various parameters, and speech is synthesized using the parameters. Since a higher quality parameter than that in synthesis by rule can be used for speech synthesis, more natural speech can be synthesized.

In some application fields, it is required to change part of text using the synthesis-by-rule method and synthesize the remaining portion using a parameter generated by analysis. In this case, speech more natural than that obtained by synthesizing the full text by rule can be obtained while partially taking advantage of the flexibility of synthesis by rule.

In this prior art, however, even when speech is synthesized by rule using only text to be embedded as a synthesis-by-rule portion, and the resultant portion is concatenated to the remaining portion based on analysis, no natural concatenation can be obtained.

For example, for a sentence "Mr. Tanaka is waiting" ("/ta/na/ka/sa/ma/ga/o/ma/chi/de/go/za/i/ma/su/" in Japanese), "Mr. Tanaka" ("/ta/na/ka/sa/ma/ga/" in Japanese) is synthesized by rule, and "is waiting" ("/o/ma/chi/de/go/za/i/ma/su/" in Japanese) is synthesized on the basis of analysis. If "/ta/na/ka/sa/ma/ga/" is synthesized by rule without considering that "/o/ma/chi/de/go/za/i/ma/su/" follows the portion, the synthesized speech sounds as if the sentence ended at that portion ("/ta/na/ka/sa/ma/ga/"). When "/o/ma/chi/de/go/za/i/ma/su/" is spoken after that portion, unnatural speech is obtained.

BRIEF SUMMARY OF THE INVENTION

Accordingly, it is an object of the present invention to provide a speech synthesis apparatus which is used to change only part of text by synthesis by rule and synthesize the remaining portion using a synthesis parameter or speech waveform data generated by analysis, and at that time, allows natural synthesis by concatenating a synthesis-by-rule portion to an analysis synthesis portion without any sense of incongruous prosody, and a method therefor.

It is another object of the present invention to provide a speech synthesis apparatus which is used to change only part of text by synthesis by rule and synthesize the remaining portion using a synthesis parameter or speech waveform data generated by analysis, and at that time, allows natural synthesis by concatenating a synthesis-by-rule portion to an analysis synthesis portion without any sense of incongruous prosody even in a speech unit where the changeable portion (unfixed form portion) and the fixed form portion are produced without any pause, and a method therefor.

According to one aspect of the present invention, there is provided a speech synthesis apparatus comprising: means for storing, for each exemplary text segment containing a fixed form portion having a fixed text segment and an unfixed form portion on which an arbitrary text segment can be specified by a user, exemplary text segment data including context information representing a context around the unfixed form portion and parameter data obtained by analyzing a speech corresponding to the fixed form portion; means, responsive to an instruction by a user, for selecting data from among the exemplary text segment data and inputting a text segment corresponding to the unfixed form portion of the selected exemplary text segment data; means for generating parameter data of at least the unfixed form portion on the basis of the inputted text segment of the unfixed form portion and a corresponding context information; and means for concatenating the generated parameter data of the unfixed form portion to the stored parameter data of the fixed form portion, and generating synthesized speech from the concatenated parameter data.

In the apparatus, the parameter data obtained by analysis may be constituted by a phonetic string and prosodic information. The exemplary text segment data may further include positional information of the unfixed form portion in the exemplary text segment. A pitch of the unfixed form portion may be shifted to substantially equal to that of the fixed form portion on their concatenated point in generating the parameter data of the unfixed form portion or generating the synthesized speech. In a case where a pause period is provided between the unfixed form portion and the fixed form portion, the pause period may be adjusted in generating the synthesized speech.

According to another aspect of the present invention, there is provided a speech synthesis apparatus comprising: means for storing, for each exemplary text segment containing a fixed form portion having a fixed text segment and an unfixed form portion on which an arbitrary text segment can be specified by a user, exemplary text segment data including context information representing a context around the unfixed form portion and speech waveform data of the fixed form portion; means, responsive to an instruction by a user, for selecting data from among the exemplary text segment data and inputting a text segment corresponding to the unfixed form portion of the selected exemplary text segment data; means for generating parameter data of at least the unfixed form portion on the basis of the inputted text segment of the unfixed form portion and a corresponding context information, and generating synthesized speech from the generated parameter data; and means for concatenating speech waveform data of the generated synthesized speech of the unfixed form portion to the stored speech waveform data of the fixed form portion, and generating synthesized speech from the concatenated speech waveform data.

In the apparatus, the exemplary text segment data may further include positional information of the unfixed form portion in the exemplary text segment. A pitch of the unfixed form portion may be shifted to substantially equal to that of the fixed form portion on their concatenated point in generating the parameter data of the unfixed form portion or generating the synthesized speech. A waveform phase of the unfixed form portion may be adjusted to be substantially equal to that of the fixed form portion on their concatenated point in generating the synthesized speech.

According to another aspect of the present invention, there is provided a speech synthesis method comprising the steps of: providing a database for storing, for each exemplary text segment containing a fixed form portion having a fixed text segment and an unfixed form portion on which an arbitrary text segment can be specified by a user, exemplary text segment data including context information representing a context around the unfixed form portion and parameter data obtained by analyzing a speech corresponding to the fixed form portion; in response to an instruction by a user, selecting data from among the exemplary text segment data and inputting a text segment corresponding to the unfixed form portion of the selected exemplary text segment data; generating parameter data of at least the unfixed form portion on the basis of the inputted text segment of the unfixed form portion and a corresponding context information; and concatenating the generated parameter data of the unfixed form portion to the stored parameter data of the fixed form portion, and generating synthesized speech from the concatenated parameter data.

In the method, the parameter data obtained by analysis may be constituted by a phonetic string and prosodic information. The exemplary text segment data may further include positional information of the unfixed form portion in the exemplary text segment. A pitch of the unfixed form portion may be shifted to substantially equal to that of the fixed form portion on their concatenated point in generating the parameter data of the unfixed form portion or generating the synthesized speech. In a case where a pause period is provided between the unfixed form portion and the fixed form portion, the pause period may be adjusted in generating the synthesized speech.

According to another aspect of the present invention, there is provided a speech synthesis method comprising the steps of: providing a database for storing, for each exemplary text segment containing a fixed form portion having a fixed text segment and an unfixed form portion on which an arbitrary text segment can be specified by a user, exemplary text segment data including context information representing a context around the unfixed form portion and speech waveform data of the fixed form portion; in response to an instruction by a user, selecting data from among the exemplary text segment data and inputting a text segment corresponding to the unfixed form portion of the selected exemplary text segment data; generating parameter data of at least the unfixed form portion on the basis of the inputted text segment of the unfixed form portion and a corresponding context information, and generating synthesized speech from the generated parameter data; and concatenating speech waveform data of the generated synthesized speech of the unfixed form portion to the stored speech waveform data of the fixed form portion, and generating synthesized speech from the concatenated speech waveform data.

In the method, the exemplary text segment data may further include positional information of the unfixed form portion in the exemplary text segment. A pitch of the unfixed form portion may be shifted to substantially equal to that of the fixed form portion on their concatenated point in generating the parameter data of the unfixed form portion or generating the synthesized speech. A waveform phase of the unfixed form portion may be adjusted to substantially equal to that of the fixed form portion on their concatenated point in generating the synthesized speech.

According to another aspect of the present invention, there is provided a storage medium storing computer-executable program code for performing speech synthesis, the program code comprising: means for causing a computer to store on a database, for each exemplary text segment containing a fixed form portion having a fixed text segment and an unfixed form portion on which an arbitrary text segment can be specified by a user, exemplary text segment data including context information representing a context around the unfixed form portion and parameter data obtained by analyzing a speech corresponding to the fixed form portion; means for causing a computer to select data from among the exemplary text segment data and inputting a text segment corresponding to the unfixed form portion of the selected exemplary text segment data in response to an instruction by a user; means for causing a computer to generate parameter data of at least the unfixed form portion on the basis of the inputted text segment of the unfixed form portion and a corresponding context information; and means for causing a computer to concatenate the generated parameter data of the unfixed form portion to the stored parameter data of the fixed form portion, and generate synthesized speech from the concatenated parameter data.

According to another aspect of the present invention, there is provided a storage medium storing computer-executable program code for performing speech synthesis, the program code comprising: means for causing a computer to store on a database, for each exemplary text segment containing a fixed form portion having a fixed text segment and an unfixed form portion on which an arbitrary text segment can be specified by a user, exemplary text segment data including context information representing a context around the unfixed form portion and speech waveform data of the fixed form portion; means for causing a computer to select data from among the exemplary text segment data and inputting a text segment corresponding to the unfixed form portion of the selected exemplary text segment data in response to an instruction by a user; means for causing a computer to generate parameter data of at least the unfixed form portion on the basis of the inputted text segment of the unfixed form portion and a corresponding context information, and generate synthesized speech from the generated parameter data; and means for causing a computer to concatenate speech waveform data of the generated synthesized speech of the unfixed form portion to the stored speech waveform data of the fixed form portion, and generate synthesized speech from the concatenated speech waveform data.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

The embodiments of the present invention will be described below with reference to the accompanying drawing.

[First Embodiment]

Figure 1:
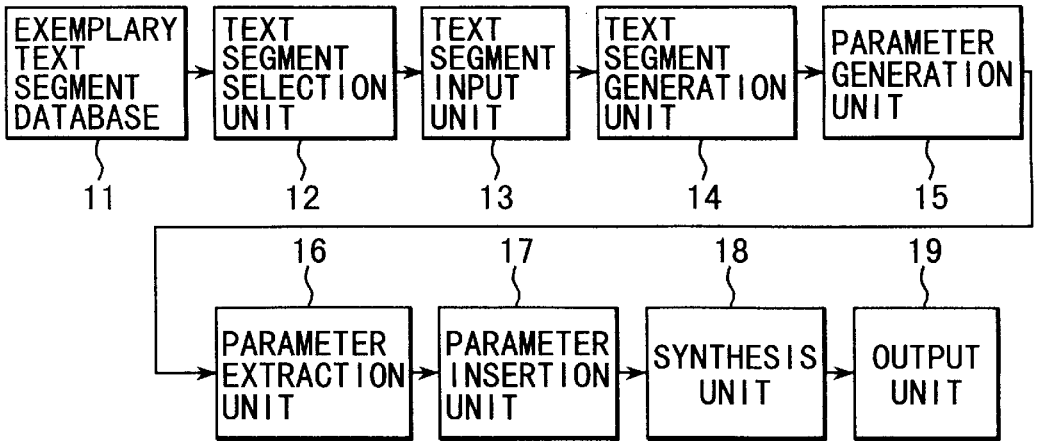
FIG. 1 is a block diagram showing the arrangement of a speech synthesis apparatus according to the first embodiment of the present invention.

FIG. 1 is a block diagram showing the arrangement of a speech synthesis apparatus according to the first embodiment of the present invention. The speech synthesis apparatus of this embodiment embeds a synthesis parameter obtained by synthesis by rule in a synthesis parameter obtained by analyzing text spoken by a person and synthesizes speech on the basis of the parameter.

More specifically, the speech synthesis apparatus shown in FIG. 1 realizes a function of adding a surrounding text segment to a text segment as an unfixed form portion to be synthesized, generating a synthesis parameter considering the context (context around the unfixed form portion) by performing synthesis by rule for both of the unfixed form portion and the surrounding text segment, extracting a parameter for a portion which is actually necessary as the unfixed form portion, and pasting the extracted parameter in the synthesis parameter of the analysis synthesis portion, thereby synthesizing speech (i.e., this apparatus realizes a function of analyzing not only the text segment to be actually embedded as the synthesis-by-rule portion but also the surrounding text segment which affects synthesis of the unfixed form portion to generate a parameter considering the surrounding context where the text segment to be synthesized by rule is to be embedded, thereby synthesizing speech).

To realize this function, the speech synthesis apparatus comprises an exemplary text segment database 11, a text segment selection unit 12, a text segment input unit 13, a text segment generation unit 14, a parameter generation unit 15, a parameter extraction unit 16, a parameter embedding unit 17, a synthesis unit 18, and an output unit 19.

Various exemplary text segment data are stored in the exemplary text segment database 11. The exemplary text segment data is constituted by a text segment for embedding synthesis (to be referred to as an exemplary text segment hereinafter) having a data structure with a format including the text segment of a fixed form portion (fixed form text segment) having fixed contents and identification character data (e.g., a specific symbol) which is set at the position of an unfixed form portion having varying contents in accordance with specification by the user and used to identify the unfixed form portion, and data such as a synthesis parameter for the text segment of the fixed form portion.

The position of the unfixed form portion is detected from the identification character data in the exemplary text segment. That is, the exemplary text segment data has the position data of the unfixed form portion, i.e., position data representing the embedding position of a text segment specified by a user. The text segment of the fixed form portion can be regarded as context information because it represents the context around the unfixed form portion. The synthesis parameter for the text segment of the fixed form portion is generated by analyzing a text segment uttered by a person (parameter for analysis synthesis). The synthesis parameter includes a phonetic string and prosodic information of a corresponding text segment. The prosodic information contains the utterance time length (phonetic length) and data representing a change in the voice pitch in uttering the text segment represented by the phonetic string. Information representing the tone or speed of utterance can be added to the context information. Additionally, information representing the presence of the fixed form portion after or before the unfixed form portion may be used in place of the text segment of the fixed form portion.

The text segment selection unit 12 has a function of extracting necessary exemplary text segment data in accordance with designation from the user when the exemplary text segment database 11 stores a plurality of text segment data.

The text segment input unit 13 acquires the text segment to be embedded in (the unfixed form portion in) the exemplary text segment selected by the text segment selection unit 12 by causing the user to input the text segment from a keyboard or the like.

The text segment generation unit 14 concatenates the input text segment and the text segment (fixed form text segment) as context information stored in the exemplary text segment database 11 in correspondence with the fixed form portion in the order of output.

The parameter generation unit 15 analyzes the text segment generated by the text segment generation unit 14 to generate a synthesis parameter necessary for speech synthesis.

The parameter extraction unit 16 extracts a parameter for a portion necessary for synthesis by rule from the synthesis parameter generated by the parameter generation unit 15. As the extraction method, since the contents of the fixed form portion to be output are known in advance, the resultant synthesis parameter is analyzed, and a portion corresponding to the fixed form portion is deleted to extract the parameter. Alternatively, not only the text segment but also index information representing the start and end of the unfixed form portion is generated by the text segment generation unit 14. Index information representing the start and end of the unfixed form portion corresponding to the parameter is generated by the parameter generation unit 15 on the basis of the index information, thereby extracting the parameter of the unfixed form portion.

The parameter embedding unit 17 concatenates the synthesis parameter of the fixed form portion and that for the synthesis-by-rule portion which is obtained by the parameter extraction unit 16. At this time, the portion generated by synthesis by rule (synthesis-by-rule portion) and the fixed form portion may have a difference in voice pitch. To equalize the voice pitch of the synthesis-by-rule portion with that of the fixed form portion, pitch information in the synthesis parameter may be shifted by a predetermined frequency or an octave interval.

The synthesis unit 18 synthesizes speech from the synthesis parameter generated by the parameter embedding unit 17.

The output unit 19 processes to produce voiced speech synthesized by the synthesis unit 18 from a loudspeaker or outputting it to a file (e.g., a disk).

Data transfer between the units is performed through a memory such as the main memory normally arranged in the computer.

Figure 2:
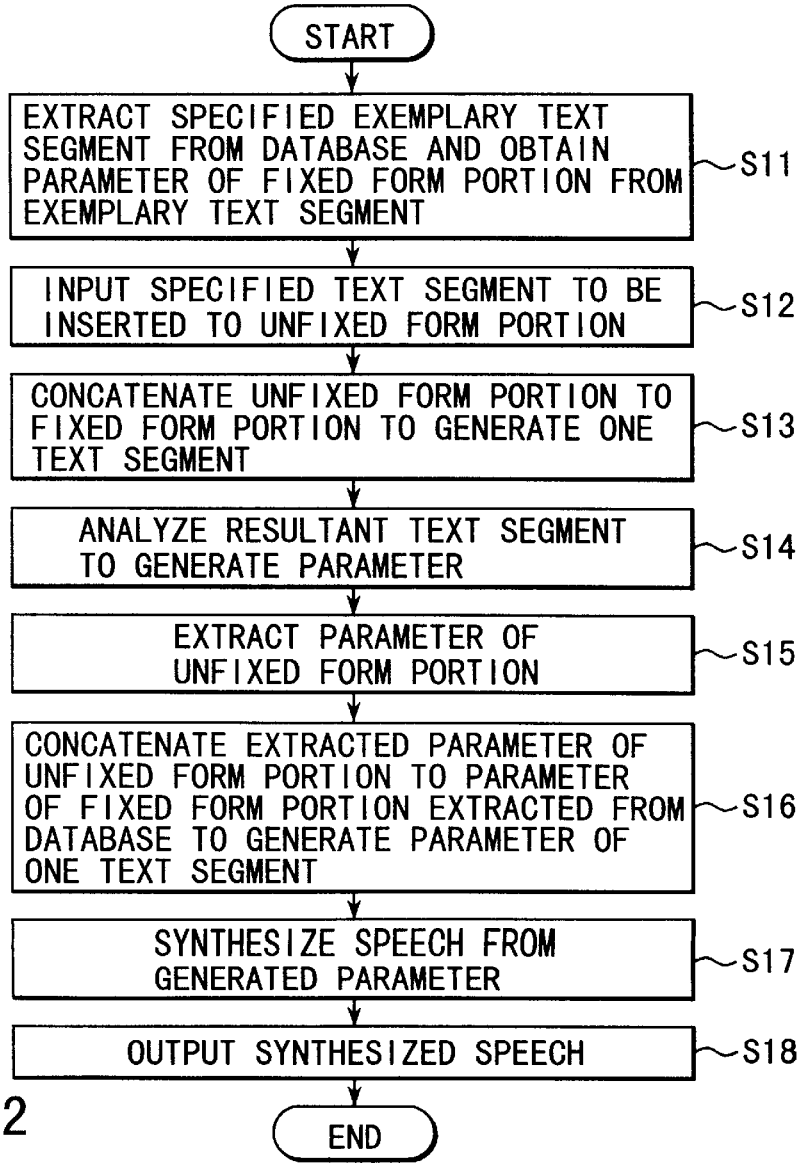
FIG. 2 is a flow chart for explaining speech synthesis processing of the speech synthesis apparatus shown in FIG. 1.

The operation of the speech synthesis apparatus shown in FIG. 1 will be described next with reference to the flow chart of FIG. 2.

First, the text segment selection unit 12 causes, through a user interface (not shown), the user to select and designate one of the plurality of text segments for embedding synthesis (exemplary text segments) stored in the exemplary text segment database 11 and extracts the designated exemplary text segment from the database 11 (step S11). The text segment selection unit 12 also acquires the synthesis parameter for the fixed form portion of the selected exemplary text segment. Assume that an exemplary text segment "(Who), is waiting" ((Who), "/o/ma/chi/de/go/za/i/ma/su/" in Japanese) is selected. In this case, "/o/ma/chi/de/go/za/i/ma/su/" is the fixed form portion. The descriptive portion "(Who)" corresponds to the unfixed form portion where a phrase "Mr. Tanaka" ("/ta/na/ka/sa/ma/ga/" in Japanese) is to be actually embedded. In this embodiment, on the data structure, a predetermined symbol, e.g., "%" as identification character data representing the unfixed form portion is used for the portion "(Who)".

Next, the control is passed from the text segment selection unit 12 to the text segment input unit 13. The text segment input unit 13 searches the exemplary text segment selectively extracted by the text segment selection unit 12 for the portion which requires an input by the user, i.e., the unfixed form portion and causes the user to input the text segment to be embedded into the unfixed form portion from the keyboard or the like (step S12). In the above example, the "(Who)" part is the unfixed form portion. The user is requested to input a text segment for this portion, and the input result is obtained. In this case, the phrase "/ta/na/ka/sa/ma/ga/" is input.

The control is passed from the text segment input unit 13 to the text segment generation unit 14. The text segment generation unit 14 concatenates the text segment of the fixed form portion as context information in the exemplary text segment selected by the text segment selection unit 12 to the text segment of the unfixed form portion, which is input by the text segment input unit 13, thereby generating a text segment (step S13). In this example, the fixed form portion and the unfixed form portion correspond to "/o/ma/chi/de/go/za/i/ma/su/" and "/ta/na/ka/sa/ma/ga/", respectively, and a sentence "/ta/na/ka/sa/ma/ga/o/ma/chi/de/go/za/i/ma/su/" is obtained.

The control is passed from the text segment generation unit 14 to the parameter generation unit 15. The parameter generation unit 15 analyzes the text segment obtained by the text segment generation unit 14 to generate a synthesis parameter (including a phonetic string and prosodic information) necessary for generating synthesized speech of this text segment (step S14). More specifically, the parameter generation unit 15 uses synthesis by rule to generate the synthesis parameter necessary for generating synthesized speech of the text segment generated by the text segment generation unit 14.

The control is passed from the parameter generation unit 15 to the parameter extraction unit 16. The parameter extraction unit 16 extracts the synthesis parameter of a portion necessary as the unfixed form portion from the synthesis parameter generated by the parameter generation unit 15 in step S14 (step S15). In this example, the synthesis parameter of "/ta/na/ka/sa/ma/ga/" is extracted.

The synthesis parameter of "/ta/na/ka/sa/ma/ga/" extracted in step S15 is extracted from the synthesis parameter generated by analyzing the sentence "/ta/na/ka/sa/ma/ga/o/ma/chi/de/go/za/i/ma/su/" including the subsequent fixed form portion "/o/ma/chi/de/go/za/i/ma/su/". That is, the synthesis parameter of "/ta/na/ka/sa/ma/ga/" obtained in step S15 is generated not only on the basis of the text segment of the unfixed form portion "/ta/na/ka/sa/ma/ga/" but also using the context information (in this case, the text segment of the fixed form portion), i.e., the context around the unfixed form portion and considering the influence of the text segment next to the unfixed form portion on speaking. Therefore, by using the synthesis parameter, speech smoothly concatenated with surrounding text segment can be synthesized.

When information representing the tone or speed of utterance is added as context information, a synthesis parameter corresponding to the tone or speed of utterance can be generated, so synthesis of speech more smoothly concatenated with surrounding text segment can be expected.

Even when information representing the presence of the fixed form portion after the unfixed form portion is used as context information in place of the text segment of the fixed form portion "/o/ma/chi/de/go/za/i/ma/su/", a synthesis parameter considering the influence of the text segments around the unfixed form portion on utterance can be generated, unlike a case wherein the synthesis parameter is generated only from the text segment of the unfixed form portion "/ta/na/ka/sa/ma/ga/". Therefore, speech smoothly concatenated with surrounding text segment can be synthesized.

In this example, the sentence pauses immediately after "/ta/na/ka/sa/ma/ga/", i.e., the unfixed form portion with a punctuation mark, and an unvoiced period is embedded to this portion. Therefore, to extract the synthesis parameter in step S15, the unvoiced period is searched for from the synthesis parameter generated by the parameter generation unit 15, and synthesis parameter up to the unvoiced period can be extracted.

The control is passed from the parameter extraction unit 16 to the parameter embedding unit 17. The parameter embedding unit 17 concatenates the synthesis parameter of the unfixed form portion, which is extracted by the parameter extraction unit 16 in step S15, to that for the fixed form portion, which is acquired from the exemplary text segment database 11 by the text segment selection unit 12 (step S16).

With this processing, the synthesis parameter of the unfixed form portion "/ta/na/ka/sa/ma/ga/", which is obtained by synthesis by rule (in consideration of the influence of the surrounding text segment and, more specifically, the fixed form portion "/o/ma/chi/de/go/za/i/ma/su/") and the synthesis parameter of the fixed form portion "/o/ma/chi/de/go/za/i/ma/su/", which is obtained by analysis (and prepared in advance) are concatenated into a synthesis parameter for one sentence. At this time, the voice pitch of the synthesis-by-rule portion is equalized with that of the fixed form portion. For this purpose, in this pattern memory integration (concatenation), the pitch patterns must also be appropriately concatenated. To concatenate the pitch patterns, the parameter generated in step S14 can be directly used. However, this embodiment uses the following method. The pitch pattern concatenation method applied to this embodiment will be described below with reference to FIGS. 3A to 3C.

Figure 3A:
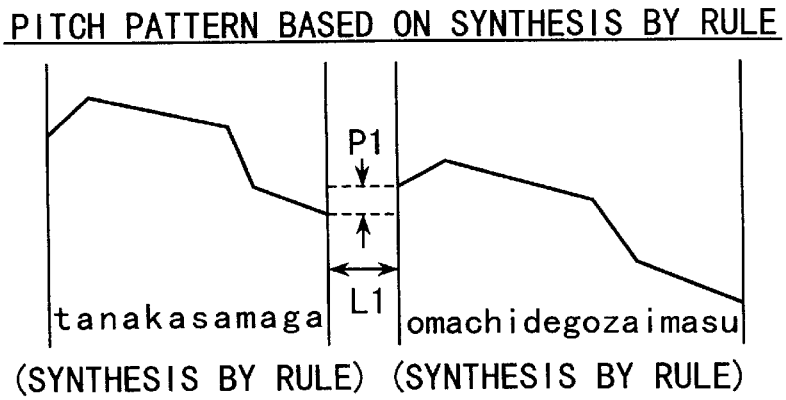
FIGS. 3A to 3C are views for explaining processing of concatenating an unfixed form portion to a fixed form portion while embedding a pause therebetween by the speech synthesis apparatus shown in FIG. 1.

FIG. 3A shows the pitch pattern in producing sounds of sentence "/ta/na/ka/sa/ma/ga/o/ma/chi/de/go/za/i/ma/su/" synthesized by rule in step S14. The portion between "/ta/na/ka/sa/ma/ga/" and "/o/ma/chi/de/go/za/i/ma/su/", where no pitch pattern is designated, indicates a pause period. P1 represents the pitch recovery width in the pause period, and L1 represents the length (time length) of the pause period.

Figure 3B:
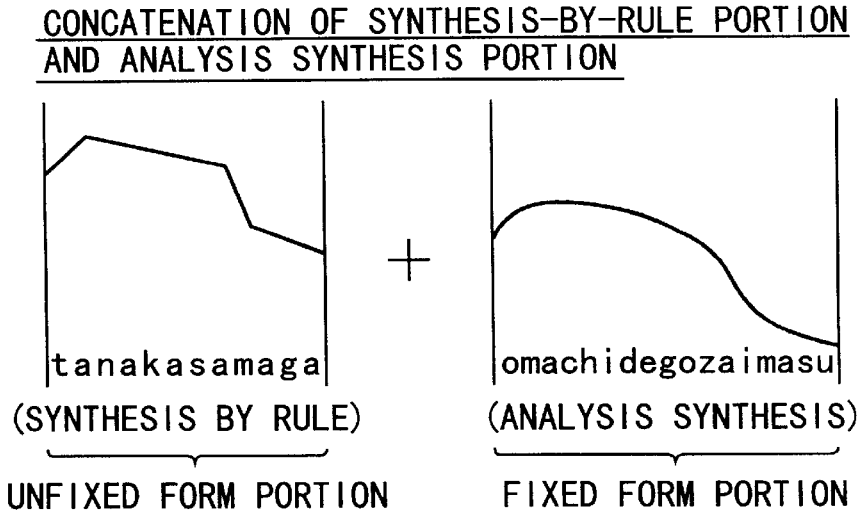

FIG. 3B shows a state wherein the pitch pattern of the unfixed form portion "/ta/na/ka/sa/ma/ga/" based on synthesis by rule, which is extracted from the pitch pattern shown in FIG. 3A, is to be concatenated to that of the fixed form portion "/o/ma/chi/de/go/za/i/ma/su/" obtained by analysis.

Figure 3C:
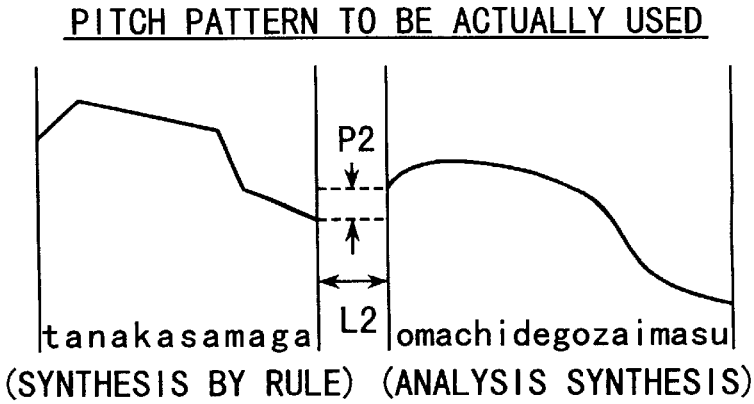

FIG. 3C shows a state wherein the pitch pattern of "/ta/na/ka/sa/ma/ga/" based on synthesis by rule is coupled (concatenated) to the pitch pattern of "/o/ma/chi/de/go/za/i/ma/su/" obtained by analysis. To concatenate the pitch patterns, the synthesis parameter of "/ta/na/ka/sa/ma/ga/" based on synthesis by rule (i.e., a synthesis parameter of the synthesis-by-rule portion) is shifted to equalize a pitch recovery width P2 at the pause period with P1 shown in FIG. 3A and a pause length L2 with L1 in FIG. 3A. Alternatively, a sentence "Mr. So-and-so/o/ma/chi/de/go/za/i/ma/su/" ("Mr. So-and-so" is arbitrary) spoken by a person may be analyzed in advance. The pitch recovery width and the pause length may be stored in the database, and the pitch recovery width P1 and the pause length L1 may be equalized with the stored width and length, respectively. When the values (pitch recovery width and pause length) obtained by analysis are to be used, instead of shifting the synthesis parameter of the synthesis-by-rule portion in concatenating the synthesis parameters in step S16, a synthesis parameter may be generated by synthesis by rule in step S14 in advance such that the pitch recovery width P2 and the pause length L2 equal the values obtained upon analysis. For the fixed form portion, a plurality of synthesis parameters for the fixed form portion may be prepared in the exemplary text segment database 11, and the parameter to be used may be changed in accordance with the accent type of the text segment of the unfixed form portion.

When the synthesis parameter of the unfixed form portion and that for the fixed form portion are concatenated by the parameter embedding unit 17 in step S16, the control is passed from the parameter embedding unit 17 to the synthesis unit 18. The synthesis unit 18 synthesizes speech from the synthesis parameter concatenated (generated) by the parameter embedding unit 17 (step S17). With this processing, the waveform data of voiced speech "/ta/na/ka/sa/ma/ga/o/ma/chi/de/go/za/i/ma/su/" can be obtained.

The fixed form portion "/o/ma/chi/de/go/za/i/ma/su/" is separated from the unfixed form portion "/ta/na/ka/sa/ma/ga/" by the unvoiced period and therefore is hardly affected by phonetic concatenation in utterance. Therefore, the waveform data of the fixed form portion "/o/ma/chi/de/go/za/i/ma/su/" may be stored in the exemplary text segment database 11 in advance and used.

The output unit 19 processes to output voiced speech synthesized by the synthesis unit 18 in step S17 to a loudspeaker or the like (step S18).

With this processing, speech of a text segment including an unfixed form portion can be synthesized in consideration of the context around the text segment to be embedded.

In the above-described speech synthesis for a text segment including an unfixed form portion, the unfixed form portion is separated from the fixed form portion by the pause period, i.e., the unfixed form portion and the fixed form portion are each spoken in one breath (as a speaking unit). However, in some cases, the unfixed form portion and the fixed form portion are continuously spoken in one breath without any pause period. Speech synthesis for a text segment including an unfixed form portion, which is performed by a speech synthesis apparatus when the embedding and fixed form portions are concatenated in one breath, will be described below. The speech synthesis apparatus has the same basic arrangement as that shown in FIG. 1, and the flow of entire processing is the same as that in FIG. 2. For the descriptive convenience, parts different from the above example will be mainly described with reference to the block diagram of FIG. 1 and the flow chart of FIG. 2.

For example, "Shinjuku" ("/si/n/ju/ku/" in Japanese) is used as (a text segment to be embedded to) the unfixed form portion, and "from" ("/ka/ra/" in Japanese) is used as (a text segment of) the fixed form portion. In the actual text segment, "come" or the like is concatenated to these text segments, though it will be omitted for the descriptive convenience.

First, in step S11, the text segment selection unit 12 obtains an exemplary text segment "(place) /ka/ra/". In this case, a text segment is to be embedded to "(place)", and actually, the text segment is described as "%/ka/ra/".

In step S12, the text segment to be embedded to "(place)" is input by the user and received by the text segment input unit 13. In this case, "/si/n/ju/ku/" is input.

In step S13, the text segment of the unfixed form portion "/si/n/ju/ku/" is concatenated to the text segment of the fixed form portion "/ka/ra/" as context information by the text segment generation unit 14, so a phrase "/si/n/ju/ku/ka/ra/" is generated.

In step S14, the phrase "/si/n/ju/ku/ka/ra/" generated in step S13 is analyzed by the parameter generation unit 15. Assuming that the unfixed form portion "/si/n/ju/ku/" and the fixed form portion "/ka/ra/" are continuously concatenated without any pause period, a corresponding synthesis parameter based on synthesis by rule is generated.

In step S15, the synthesis parameter for a portion which is to be actually used as the unfixed form portion, i.e., "/si/n/ju/ku/" is extracted by the parameter extraction unit 16 from the synthesis parameter generated in step S14.

Processing of extracting the synthesis parameter of "/si/n/ju/ku/" from the synthesis parameter for the phrase "/si/n/ju/ku/ka/ra/" to be spoken in one breath (without any pause period) will be described with reference to FIGS. 4A to 4C.

Figure 4A:
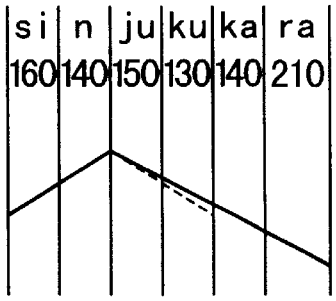
FIGS. 4A to 4C are views for explaining processing of continuously concatenating an unfixed form portion to a fixed form portion by the speech synthesis apparatus shown in FIG. 1.

With processing in step S14, the parameter as shown in FIG. 4A, which is used to synthesize the full text segment "/si/n/ju/ku/ka/ra/" by rule, is generated (if synthesis by rule is performed using only "/si/n/ju/ku/", the pitch pattern is indicated by the broken line in FIG. 4A). Referring to FIG. 4A, syllables from "/si/" to "/ra/" represent a string of sounds obtained by analyzing the phrase "/si/n/ju/ku/ka/ra/". The numerical value under each syllable represents the utterance time length of the syllable. The hill-shaped graph under the numerical values represents a change in the voice pitch in utterance. The vertical lines indicate the boundaries of syllables, and the interval between two lines depends on the time length of the syllable. The value representing the pitch is given at a predetermined time interval (frame).

Figure 4B:
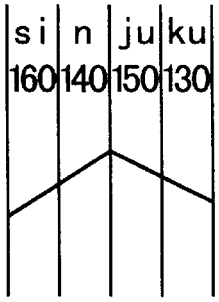
Figure 4B:
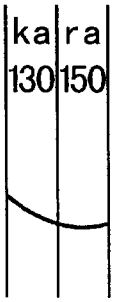

In step S15, a synthesis parameter representing the portion which is to be actually used as the unfixed form portion as shown in FIG. 4B, i.e., "/si/n/ju/ku/" is extracted from the synthesis parameter shown in FIG. 4A. Details of this processing will be described below.

As is known in advance, the last portion "/ka/ra/" is unnecessary because this portion is registered in the exemplary text segment database 11 as the fixed form portion of the exemplary text segment "(place) /ka/ra/". For this reason, a parameter representing the types and time lengths of syllables can be extracted from the synthesis parameter of "/si/n/ju/ku/ka/ra/" by deleting the data of the last two syllables from the parameter.

For the pitch parameter, the number of data always changes because the number and lengths of syllables change depending on the text segment to be embedded to the unfixed form portion. Therefore, the number of pitch parameters necessary for representing "/si/n/ju/ku/" is calculated from the sum of syllable lengths of this portion, and pitch parameters in the calculated number are extracted from the start of the pitch data. With this processing, a synthesis parameter of "/si/n/ju/ku/", which is necessary for naturally speaking "/si/n/ju/ku/ka/ra/", can be obtained.

In step S16, the synthesis parameter extracted in step S15 is concatenated, by the parameter embedding unit 17, to that of "/ka/ra/" which is registered in the exemplary text segment database 11 as the fixed form portion of the exemplary text segment "(place) /ka/ra/".

Figure 4C:
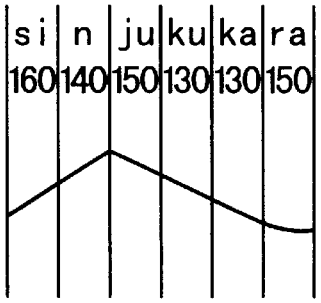

This processing in step S16 corresponds to processing of concatenating the parameter of the unfixed form portion "/si/n/ju/ku/" shown in FIG. 4B, which is obtained by synthesis by rule and extracted in step S15, to the parameter of the fixed form portion "/ka/ra/", which is obtained by analysis synthesis, to generate a parameter representing "/si/n/ju/ku/ka/ra/" shown in FIG. 4C. Simply speaking, the parameter of "/ka/ra/" is directly concatenated to the parameter of "/si/n/ju/ku/". However, even when the context is taken into consideration in synthesis by rule, the parameter may differ from that based on analysis. For this reason, when the parameter of "/ka/ra/" is directly concatenated to the parameter of "/si/n/ju/ku/", pitch discontinuity may be generated at the concatenation portion.

To properly continuously connect the pitch patterns, processing of, e.g., shifting all the values of pitch data of the unfixed form portion such that the end value of the pitch data of the unfixed form portion equals the start value of the fixed form portion is performed in, e.g., step S16. The values of pitch data of the unfixed form portion may be shifted in step S14 such that the start value of pitch data of a portion corresponding to the fixed form portion generated by synthesis by rule together with the unfixed form portion in step S14 equals the start value of pitch data stored in the exemplary text segment database 11 as the fixed form portion. Alternatively, the end value of pitch data of the unfixed form portion may be stored in the exemplary text segment database 11 together with the data of the fixed form portion, and the pitch data of the unfixed form portion may be shifted such that the end value of pitch data of the unfixed form portion generated by synthesis by rule equals the stored value. This processing can cope with a large change in pitch between the unfixed form portion and the fixed form portion, and this method is more advantageous than the method of equalizing the end value of pitch data of the unfixed form portion with the start value of pitch data of the fixed form portion.

In step S17, waveform data is generated by the synthesis unit 18 from the synthesis parameter generated in step S16. In step S18, the output unit 19 outputs speech based on the waveform data.

With this processing, speech of a text segment including an unfixed form portion can be synthesized in consideration of the context around the word or phrase to be embedded.

[Second Embodiment]

Figure 5:
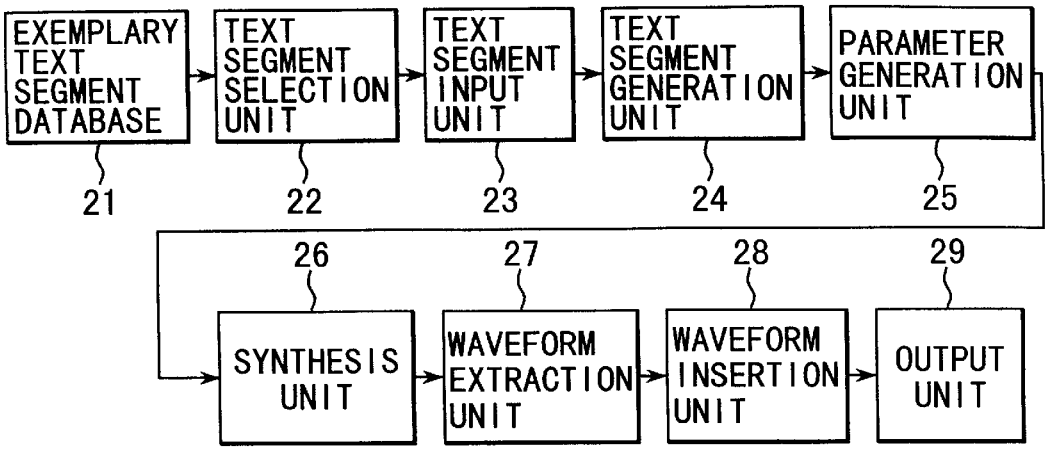
FIG. 5 is a block diagram showing the arrangement of a speech synthesis apparatus according to the second embodiment of the present invention.

FIG. 5 is a block diagram showing the arrangement of a speech synthesis apparatus according to the second embodiment of the present invention. The speech synthesis apparatus of this embodiment embeds voiced speech generated by synthesis by rule to an utterance by a person.

More specifically, the speech synthesis apparatus shown in FIG. 5 realizes a function of adding a surrounding text segment to a text segment to be synthesized by rule as an unfixed form portion, synthesizing speech of the unfixed form portion in consideration of the context (context around the unfixed form portion) by performing synthesis by rule for the unfixed form portion and the surrounding text segment, and pasting the synthesized speech in the speech of the fixed form portion.

To realize this function, the speech synthesis apparatus comprises an exemplary text segment database 21, a text segment selection unit 22, a text segment input unit 23, a text segment generation unit 24, a parameter generation unit 25, a synthesis unit 26, a waveform extraction unit 27, a waveform embedding unit 28, and an output unit 29.

The exemplary text segment database 21, the text segment selection unit 22, the text segment input unit 23, the text segment generation unit 24, and the parameter generation unit 25 have the same functions as those of the exemplary text segment database 11, the text segment selection unit 12, the text segment input unit 13, the text segment generation unit 14, and the parameter generation unit 15 in FIG. 1, and a detailed description thereof will be omitted. However, the exemplary text segment database 21 stores, as data of the fixed form portion in the exemplary text segment, not the synthesis parameter but speech data (speech waveform data) of the fixed form portion, unlike the exemplary text segment database 11. The speech data may be compressed and stored. The parameter generation unit 25 may have a function of adjusting the generated synthesis parameter to equalize the voice pitch for the text segment to be embedded with that for speech to be added.

The synthesis unit 26 synthesizes speech from the synthesis parameter generated by the parameter generation unit 25.

The waveform extraction unit 27 extracts a portion necessary as the unfixed form portion from the speech synthesized by the synthesis unit 26.

The waveform embedding unit 28 concatenates the speech waveform of the unfixed form portion, which is extracted by the waveform extraction unit 27, to that of the fixed form portion to generate a synthesized waveform to be output.

The output unit 29 processes to produce the waveform generated by the waveform embedding unit 28 from a loudspeaker or outputting it to a file (e.g., a disk).

Figure 6:
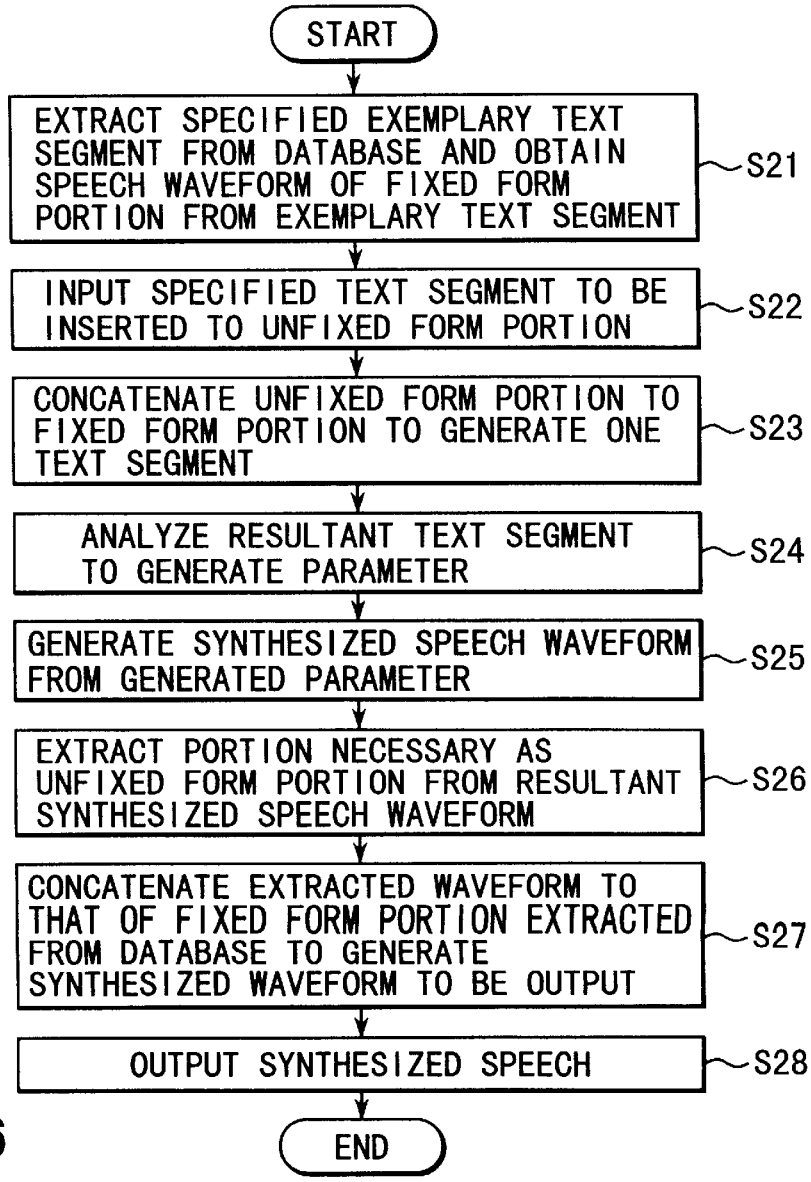
FIG. 6 is a flow chart for explaining speech synthesis processing of the speech synthesis apparatus shown in FIG. 5.

The operation of the speech synthesis apparatus shown in FIG. 5 will be described next with reference to the flow chart of FIG. 6.

First, the text segment selection unit 22 causes the user to select and designate one of a plurality of exemplary text segments stored in the exemplary text segment database 21 and extracts the designated exemplary text segment from the exemplary text segment database 21 (step S21). The text segment selection unit 22 also extracts speech data of the fixed form portion of the selected exemplary text segment. Step S21 is different from step S11 in the first embodiment in this extraction of speech data of the fixed form portion.

The operation of the text segment input unit 23 in step S22 to the operation of the parameter generation unit 25 in step S24 are the same as the operation of the text segment input unit 13 in step S12 to the operation of the parameter generation unit 15 in step S14 in the first embodiment, and a detailed description thereof will be omitted.

In step S24, a synthesis parameter necessary for synthesizing speech of the text segment obtained by the text segment generation unit 24 is generated, and then, the control is passed from the parameter generation unit 25 to the synthesis unit 26. The synthesis unit 26 generates a synthesized speech waveform from the synthesis parameter generated by the text segment generation unit 24 (step S25).

The control is passed from the synthesis unit 26 to the waveform extraction unit 27. The waveform extraction unit 27 extracts a waveform portion necessary as the unfixed form portion from the synthesized speech waveform generated by the synthesis unit 26 in step S25 (step S26).

Next, the control is passed from the waveform extraction unit 27 to the waveform embedding unit 28. The waveform embedding unit 28 concatenates the speech waveform of the fixed form portion extracted from the exemplary text segment database 21 by the text segment selection unit 22 to the waveform of the unfixed form portion, which is extracted by the waveform extraction unit 27 in step S26, thereby synthesizing a waveform to be output (step S27).

The output unit 29 processes to, e.g., output the waveform synthesized by the waveform embedding unit 28 to a loudspeaker (step S28).

With the above processing, speech of a text segment including an unfixed form portion can be synthesized in consideration of the context around the text segment to be embedded.

Processing of concatenating the unfixed form portion to the fixed form portion without any particular awareness of concatenation of speech waveforms has been described above. This processing is especially effective when no awareness is required for concatenation between phonemes because the unfixed form portion is separated from the fixed form portion by an unvoiced period or the speech power sufficiently decreases at the concatenation portion. However, if phonemes are concatenated without embedding any unvoiced period, waveform discontinuity may occur, and noise may be generated at the discontinuous portion (concatenation portion). Speech synthesis for a text segment including an unfixed form portion by a speech synthesis apparatus for concatenating phonemes will be described below. The speech synthesis apparatus has the same basic arrangement as that shown in FIG. 5, and the flow of entire processing is the same as in FIG. 6. For the descriptive convenience, parts different from the above example will be mainly described with reference to the block diagram of FIG. 5 and the flow chart of FIG. 6.

In step S24, the parameter generation unit 25 generates a synthesis parameter such that the pitch of the unfixed form portion equals that of the fixed form portion near the contact point between the speech waveform of the unfixed form portion and that of the fixed form portion, i.e., near the transient point between the unfixed form portion and the fixed form portion. This processing can be realized by, e.g., shifting the values of pitch data of the unfixed form portion.

In step S26, the waveform extraction unit 27 extracts the waveform of the unfixed form portion from the synthesized speech waveform generated by the synthesis unit 26 in step S25 on the basis of the synthesis parameter generated by the parameter generation unit 25. In extracting the waveform of the unfixed form portion, the waveform extraction unit 27 extracts not only the waveform of the unfixed form portion but also an excess waveform corresponding to the minimum pitch necessary for adjusting the phase shift with some margin for interpolation to the fixed form portion.

Figure 7:
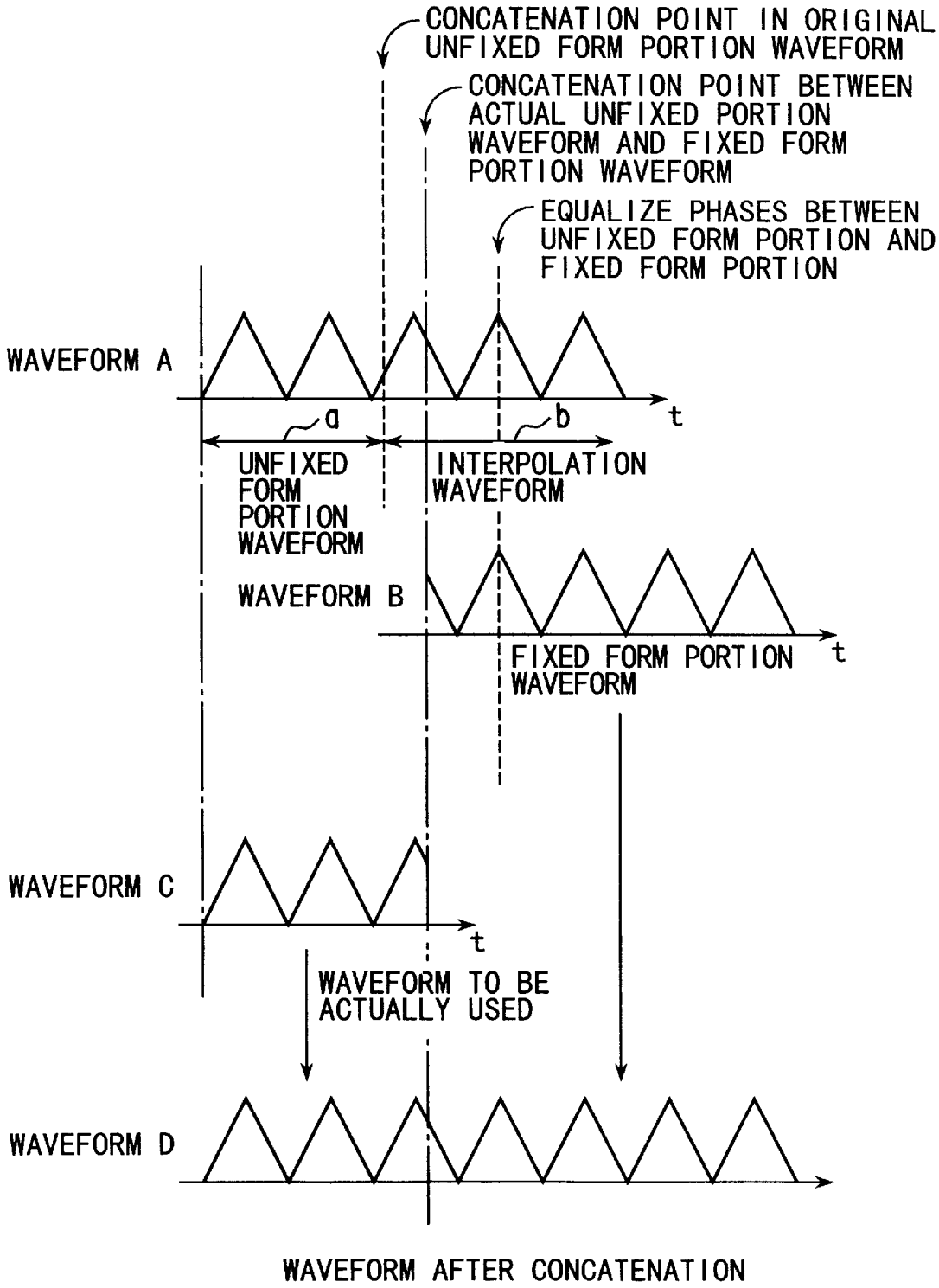
FIG. 7 is a view for explaining processing of continuously concatenating an unfixed form portion to a fixed form portion by the speech synthesis apparatus shown in FIG. 5.

The waveform embedding unit 28 concatenates the waveform of the unfixed form portion to that of the fixed form portion in step S27. Concatenation is performed after position adjustment such that the phases of waveforms match at the concatenation portion. Interpolation may be performed near the concatenation portion to smoothly connect the waveforms. If the waveform powers can also be equalized by the parameter generation unit 25 in step S24, the waveforms may be directly concatenated without interpolation. FIG. 7 shows processing in step S27 to which the above method is applied.

In a waveform A of a triangular wave shown in FIG. 7, a section "a" corresponding to the "unfixed form portion waveform" is a waveform portion necessary as the unfixed form portion, and this can be obtained by calculating the phonetic length. A section "b" corresponding to the "interpolation waveform" indicates a margin for interpolation. A waveform B in FIG. 7 represents the waveform of the fixed form portion (fixed form portion waveform).

A phase shift is present between the end of the "unfixed form portion waveform" in the waveform A and the start of the fixed form portion waveform in the waveform B. For this reason, when the "unfixed form portion waveform" in the waveform A is directly concatenated to the fixed form portion waveform in the waveform B, noise or the like is generated. To prevent this, the waveform embedding unit 28 performs adjustment using the "interpolation waveform" (interpolation period) by shifting the time position such that the phases of the waveforms A and B match. The waveforms A and B match at their vertices in phase.

The waveform embedding unit 28 extracts the unfixed form portion corresponding to the waveform C from the waveform A, including the interpolation portion necessary for concatenation to the waveform B. The waveform embedding unit 28 concatenates the unfixed form portion with an extracted waveform C to the fixed form portion with the waveform B (together with the interpolation portion), thereby generating synthesized speech with a waveform D. In the above description, the phases are adjusted along a direction of increasing the speech length of the unfixed form portion. However, the phases may be adjusted along a direction of decreasing the speech length.

When the waveform arrangement position can be arbitrarily determined in synthesizing speech as in waveform synthesis, the waveform of the unfixed form portion can be generated by the synthesis unit 26 such that the phase of the waveform of the unfixed form portion matches that of the fixed form portion at the concatenation position. This method is more advantageous because the phoneme length does not change in phase adjustment at the concatenation position.

The above-described processing procedures (processing procedures shown in the flow charts of FIGS. 2 and 6) of the speech synthesis apparatuses of the first and second embodiments are realized by causing a computer such as a personal computer capable of loading a program to load a program recorded on a recording medium such as a CD-ROM, a DVD-ROM, a floppy disk, or a memory card and execute the program. The contents of the recording medium having the program maybe downloaded to the computer through a communication medium or the like.

The present invention is not limited to the above embodiments.

For example, in the second embodiment, all the synthesis parameters generated by the parameter generation unit 25 are synthesized by the synthesis unit 26, and a necessary portion is extracted by the waveform extraction unit 27. However, only a section to be extracted by the waveform extraction unit 27 may be synthesized by the synthesis unit 26 and used by the waveform embedding unit 28. In this case, the waveform extraction unit 27 can be omitted.

(The parameter generation unit 15 or parameter generation unit 25) of the first or second embodiment generates the synthesis parameter for the entire text segment including the fixed form portion by analysis. However, the synthesis parameter may be generated only on the basis of the unfixed form portion, though the fixed form portion is taken into consideration in generating the synthesis parameter (i.e., the context around the text segment of the unfixed form portion is taken into consideration).

In the second embodiment, when concatenation between phonemes of the unfixed form portion and the fixed form portion is to be taken into consideration, waveform data necessary for interpolation is obtained only on the basis of the unfixed form portion. However, the interpolation period may be obtained from the speech data of the fixed form portion stored in the exemplary text segment database 21 or from both of the unfixed form portion and the fixed form portion. However, to obtain the interpolation period from the fixed form portion, processing of, e.g., storing speech data of each phoneme is required because the phoneme at the end of the unfixed form portion cannot be specified.

In the first and second embodiments, to reflect the surrounding contexts on generation of the synthesis parameter of the unfixed form portion, the text segment of the unfixed form portion is embedded in the surrounding text segment, and the entire text segment is analyzed. However, the analysis contents determined only on the basis of the contents of the fixed form portion independently of the contents of the unfixed form portion may be processed in advance and held in the database (the exemplary text segment database 11 or 21). In actual unfixed form portion synthesis, the held information may be used to decrease the processing amount.

In the first embodiment, the synthesis parameter of the fixed form portion, which is held in the exemplary text segment database 11, is obtained by analyzing the speech. However, a synthesis parameter may be generated by synthesis by rule from a text, optimized by correction, and held in the exemplary text segment database.

In the first and second embodiments, an arbitrary text segment is embedded as the unfixed form portion and analyzed to generate a synthesis parameter. However, these embodiments can also be applied when the types of text segments to be embedded to the unfixed form portion are determined (prepared) in advance, and one of the text segments is selected by the user. In this case, the data of the unfixed form portion is held in the exemplary text segment database in the form of a synthesis parameter optimized for each text segment to be embedded or in a data format for allowing generation of a high-quality synthesis parameter.

As has been described above in detail, according to the present invention, speech can be synthesized with an improved sense of concatenation to the surrounding text segment by generating the synthesis parameter for the text segment to be embedded in consideration of the influence of the surrounding text segment and using the synthesis parameter for speech synthesis. Since the fixed form portion and the unfixed form portion can be generated using the same speech synthesis method after generation of the synthesis parameter, the sound quality of the fixed form portion can be equalized with that of the unfixed form portion.

In addition, according to the present invention, even in an output unit where the unfixed form portion and the fixed form portion are to be spoken without any pause, speech can be synthesized with an improved sense of concatenation between the unfixed form portion and the surrounding text segment, and the sound quality of the fixed form portion can be equalized with that of the unfixed form portion.

Furthermore, according to the present invention, since the speech of the text segment to be embedded is synthesized in consideration of the influence of the surrounding text segment, speech with an improved sense of concatenation to the surrounding text segment can be synthesized. In addition, since speech based on actual utterances can be used as the fixed form portion, the naturalness of the fixed form portion is improved.

Furthermore, according to the present invention, the concatenation portion at which the fixed form portion and the unfixed form portion are continuously spoken can be smoothly synthesized.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A speech synthesis apparatus comprising:

means for storing, for each exemplary text segment containing a fixed form portion having a fixed text segment and an unfixed form portion on which an arbitrary text segment can be specified by a user, exemplary text segment data including context information relating to the fixed form portion to be connected with the unfixed form portion and parameter data obtained by analyzing a speech corresponding to the fixed form portion;

means, responsive to an instruction by a user, for selecting data from among the exemplary text segment data and inputting a text segment corresponding to the unfixed form portion of the selected exemplary text segment data;

means for generating parameter data of at least the unfixed form portion on the basis of the inputted text segment of the unfixed form portion and corresponding context information; and means for concatenating the generated parameter data of the unfixed form portion to the stored parameter data of the fixed form portion, and generating synthesized speech from the concatenated parameter data.

2. An apparatus according to claim 1, wherein the parameter data obtained by analysis is constituted by a phonetic string and prosodic information.

3. An apparatus according to claim 1, wherein the exemplary text segment data further includes positional information of the unfixed form portion in the exemplary text segment.

4. An apparatus according to claim 1, wherein a pitch of the unfixed form portion is shifted to substantially equal to that of the fixed form portion on their concatenated point in generating the parameter data of the unfixed form portion or generating the synthesized speech.

5. An apparatus according to claim 1, wherein in a case where a pause period is provided between the unfixed form portion and the fixed form portion, the pause period is adjusted in generating the synthesized speech.

6. A speech synthesis apparatus comprising:

means for storing, for each exemplary text segment containing a fixed form portion having a fixed text segment and an unfixed form portion on which an arbitrary text segment can be specified by a user, exemplary text segment data including context connected with the unfixed form portion and speech waveform data of the fixed form portion; information relating to the fixed form portion to be means, responsive to an instruction by a user, for selecting data from among the exemplary text segment data and inputting a text segment corresponding to the unfixed form portion of the selected exemplary text segment data;

means for generating parameter data of at least the unfixed form portion on the basis of the inputted text segment of the unfixed form portion and corresponding context information, and generating synthesized speech from the generated parameter data; and means for concatenating speech waveform data of the generated synthesized speech of the unfixed form portion to the stored speech waveform data of the fixed form portion, and generating synthesized speech from the concatenated speech waveform data.

7. An apparatus according to claim 6, wherein the exemplary text segment data further includes positional information of the unfixed form portion in the exemplary text segment.

8. An apparatus according to claim 6, wherein a pitch of the unfixed form portion is shifted to substantially equal to that of the fixed form portion on their concatenated point in generating the parameter data of the unfixed form portion or generating the synthesized speech.

9. An apparatus according to claim 6, wherein a waveform phase of the unfixed form portion is adjusted to substantially equal to that of the fixed form portion on their concatenated point in generating the synthesized speech.

10. A speech synthesis method comprising the steps of:

providing a database for storing, for each exemplary text segment containing a fixed form portion having a fixed text segment and an unfixed form portion on which an arbitrary text segment can be specified by a user, exemplary text segment data including context information relating to the fixed form portion to be connected with the unfixed form portion and parameter data obtained by analyzing a speech corresponding to the fixed form portion;

in response to an instruction by a user, selecting data from among the exemplary text segment data and inputting a text segment corresponding to the unfixed form portion of the selected exemplary text segment data; generating parameter data of at least the unfixed form portion on the basis of the inputted text segment of the unfixed form portion and corresponding context information; and concatenating the generated parameter data of the unfixed form portion to the stored parameter data of the fixed form portion, and generating synthesized speech from the concatenated parameter data.

11. A method according to claim 10, wherein the parameter data obtained by analysis is constituted by a phonetic string and prosodic information.

12. A method according to claim 10, wherein the exemplary text segment data further includes positional information of the unfixed form portion in the exemplary text segment.

13. A method according to claim 10, wherein a pitch of the unfixed form portion is shifted to substantially equal to that of the fixed form portion on their concatenated point in generating the parameter data of the unfixed form portion or generating the synthesized speech.

14. A method according to claim 10, wherein in a case where a pause period is provided between the unfixed form portion and the fixed form portion, the pause period is adjusted in generating the synthesized speech.

15. A speech synthesis method comprising the steps of:

providing a database for storing, for each exemplary text segment containing a fixed form portion having a fixed text segment and an unfixed form portion on which an arbitrary text segment can be specified by a user, exemplary text segment data including context information relating to the fixed form portion to be connected with the unfixed form portion and speech waveform data of the fixed form portion;

in response to an instruction by a user, selecting data from among the exemplary text segment data and inputting a text segment corresponding to the unfixed form portion of the selected exemplary text segment data;

generating parameter data of at least the unfixed form portion on the basis of the inputted text segment of the unfixed form portion and corresponding context information, and generating synthesized speech from the generated parameter data; and concatenating speech waveform data of the generated synthesized speech of the unfixed form portion to the stored speech waveform data of the fixed form portion, and generating synthesized speech from the concatenated speech waveform data.

16. A method according to claim 15, wherein the exemplary text segment data further includes positional information of the unfixed form portion in the exemplary text segment.

17. A method according to claim 15, wherein a pitch of the unfixed form portion is shifted to substantially equal to that of the fixed form portion on their concatenated point in generating the parameter data of the unfixed form portion or generating the synthesized speech.

18. A method according to claim 15, wherein a waveform phase of the unfixed form portion is adjusted to substantially equal to that of the fixed form portion on their concatenated point in generating the synthesized speech.

19. A storage medium storing computer-executable program code for performing speech synthesis, the program code comprising:

means for causing a computer to store on a database, for each exemplary text segment containing a fixed form portion having a fixed text segment and an unfixed form portion on which an arbitrary text segment can be specified by a user, exemplary text segment data including context information relating to the fixed form portion to be connected with the unfixed form portion and parameter data obtained by analyzing a speech corresponding to the fixed form portion;

means for causing a computer to select data from among the exemplary text segment data and inputting a text segment corresponding to the unfixed form portion of the selected exemplary text segment data in response to an instruction by a user;

means for causing a computer to generate parameter data of at least the unfixed form portion on the basis of the inputted text segment of the unfixed form portion and corresponding context information; and means for causing a computer to concatenate the generated parameter data of the unfixed form portion to the stored parameter data of the fixed form portion, and generate synthesized speech from the concatenated parameter data.

20. A storage medium storing computer-executable program code for performing speech synthesis, the program code comprising;

means for causing a computer to store on a database, for each exemplary text segment containing a fixed form portion having a fixed text segment and an unfixed form portion on which an arbitrary text segment can be specified by a user, exemplary text segment data including context information relating to the fixed form portion to be connected with the unfixed form portion and speech waveform data of the fixed form portion;

means for causing a computer to select data from among the exemplary text segment data and inputting a text segment corresponding to the unfixed form portion of the selected exemplary text segment data in response to an instruction by a user;

means for causing a computer to generate parameter data of at least the unfixed form portion on the basis of the inputted text segment of the unfixed form portion and corresponding context information, and generate synthesized speech from the generated parameter data; and means for causing a computer to concatenate speech waveform data of the generated synthesized speech of the unfixed form portion to the stored speech waveform data of the fixed form portion, and generate synthesized speech from the concatenated speech waveform data.

* * * * *

UNITED STATES PATENT AND TRADEMARK OFFICE

CERTIFICATE OF CORRECTION

PATENT NO. : 6,212,501 B1
DATED : April 3, 2001
INVENTOR(S) : Osamu Kaseno

It is certified that error appears in the above-identified patent and that said Letters Patent is hereby corrected as shown below:

Title page,
Item [54], in the title, after "SPEECH SYNTHESIS APPARATUS AND METHOD", insert -- USING ANALYSIS-GENERATED SYNTHESIS AND SYNTHESIS BY RULE --.

Signed and Sealed this

First Day of October, 2002

*Attest:*

*Attesting Officer*

JAMES E. ROGAN
*Director of the United States Patent and Trademark Office*